US011319146B2

(12) United States Patent
Muhammad et al.

(10) Patent No.: US 11,319,146 B2
(45) Date of Patent: May 3, 2022

(54) APPARATUS FOR CONFINING TRASH CANS

(71) Applicants: Jabari S. Muhammad, Pembroke Township, IL (US); Edward Moore, Pembroke Township, IL (US); Jamil H. Moore, Pembroke Township, IL (US)

(72) Inventors: Jabari S. Muhammad, Pembroke Township, IL (US); Edward Moore, Pembroke Township, IL (US); Jamil H. Moore, Pembroke Township, IL (US)

( * ) Notice: Subject to any disclaimer, the term of this patent is extended or adjusted under 35 U.S.C. 154(b) by 0 days.

(21) Appl. No.: 17/524,249

(22) Filed: Nov. 11, 2021

(65) Prior Publication Data

US 2022/0063905 A1 Mar. 3, 2022

Related U.S. Application Data

(60) Provisional application No. 63/211,949, filed on Jun. 17, 2021.

(51) Int. Cl.
*B65F 1/14* (2006.01)

(52) U.S. Cl.
CPC ..... *B65F 1/1426* (2013.01)

(58) Field of Classification Search
CPC ..... B65F 1/1426; B65F 1/141; B65F 1/006; B65F 1/004
USPC ..... 220/23.87
See application file for complete search history.

(56) References Cited

U.S. PATENT DOCUMENTS

| | | | | | |
|---|---|---|---|---|---|
| 3,065,858 | A * | 11/1962 | Raymond | B65F 1/141 | 211/84 |
| 3,407,941 | A * | 10/1968 | Schmidt | B65F 1/1426 | 211/84 |
| D253,805 | S * | 1/1980 | Klick | D25/35 | |
| 4,600,109 | A * | 7/1986 | Schulz | B65F 1/141 | 211/85.19 |
| 5,549,097 | A * | 8/1996 | Nimberger | F02D 41/22 | 123/690 |
| 10,137,918 | B2 * | 11/2018 | Mellon | B62B 3/104 | |
| 2005/0274723 | A1 * | 12/2005 | Enayati | B65F 1/1426 | 220/23.86 |
| 2011/0089179 | A1 * | 4/2011 | Flewelling | B65F 1/006 | 220/524 |

* cited by examiner

*Primary Examiner* — Shawn M Braden
(74) *Attorney, Agent, or Firm* — Barry Choobin; Patent 360

(57) ABSTRACT

An apparatus for confining trash cans has a substantially E-shape upstanding frame. The frame has a left wall, a right wall, a rear wall, and a dividing wall. The left wall, the first part of the rear wall, and the dividing wall form a left enclosure, and the right wall, a second part of the rear wall, and the dividing wall form a right enclosure. Each the left enclosure and the right enclosure can accommodate a trash can. A first barrier closes an open front of the left enclosure, and a second barrier closes an open front of the right enclosure. Each the left enclosure and the right enclosure can have an open top. A first strap extends between the left wall and the dividing wall, and a second strap extends between the dividing wall and the right wall. Both the first strap and the second strap are such that to press the lid of the trash can in a close state i.e., over the container to prevent any leakage of the smell.

16 Claims, 4 Drawing Sheets

APPARATUS FOR CONFINING TRASH CANS

CROSS-REFERENCE TO RELATED APPLICATIONS

This application claims priority from a U.S. provisional patent Ser. No. 63/211,949 filed on Jun. 17, 2021, which is incorporated herein by reference in its entirety.

BACKGROUND

Trash cans are kept in front of a house/building or nearby a street so that a trashman can pick the garbage from the trash can. Waste from the household either loose or in bags is put into the trash cans. The trashman collects the garbage by inverting the trash cans in a truck either manually or using hydraulics. For these reasons, the trash cans are portable that could be lifted and inverted for emptying the trash can. However, keeping the trash cans portable and lightweight has one major problem of tipping over or blowing away. The trash can get tipped due to a number of reasons resulting in the littering of the garbage over the ground. Moreover, harsh winds easily blow away the unsecured trash cans resulting in the garbage scattered over a large area. Strong winds such as tornados can blow the trash cans quite a distance far and the garbage is scattered almost everywhere. The scattered garbage can be an eyesore, produce a stinky smell, unhygienic, and troublesome.

Food items in the garbage tend to draw the attention of animals. Open lids of the trash cans and scattered garbage attract street animals that can become a menace to people. Moreover, the garbage can be hazardous to the animals resulting in choking, entangling, or other health hazards. In places nearby wildlife, there is an additional risk of attracting wild animals which can put the residence in danger of being attacked.

Thus, a need is appreciated for an apparatus to overcome the aforesaid problems faced by people, and in particular, people living in places nearby wildlife or having frequent strong winds.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an apparatus to confine the trash cans.

It is another object of the present invention that the apparatus keeps the trash cans secured against winds.

It is still another object of the present invention that the apparatus can keep the lids of the trash cans pressed and closed.

It is a further object of the present invention that the apparatus is easy to install and remove.

It is still a further object of the present invention that apparatus is economical to manufacture and install.

It is an additional object of the present invention that the apparatus is aesthetic in appearance.

In one aspect, disclosed is an apparatus comprising an upstanding frame. The frame has a left wall, a right wall, a rear wall, and a dividing wall. The left wall and the right wall extend substantially perpendicularly from opposite left and right sides of the rear wall in the same direction. The dividing wall extends from the mid or near mid-rear wall and in the same direction as the right wall or the left wall forming an "E" shape frame. The left wall, a part of the rear wall, and the dividing wall form a left enclosure, and the right wall, a part of the rear wall, and the dividing wall form a right enclosure. Each the left enclosure and the right enclosure can accommodate a trash can. A first barrier closes an open front of the left enclosure and a second barrier closes an open front of the right enclosure. Each the left enclosure and the right enclosure can have an open top. A first strap extends between the left wall and the dividing wall and a second strap extends between the dividing wall and the right wall. Both the first strap and the second strap are such that to press the lid of the trash can in a close state i.e., over the container to prevent any leakage of the smell. A fastening mechanism can also be provided for both the straps to loosen or tighten the straps, or to increase or decrease the length of either or both the first strap and the second strap.

In one aspect, the apparatus may further include a floor panel/ramp that extends between the lower ends of the left wall, the dividing wall, and the right wall. The floor panel can be made from a rubbery material or can have a top layer of rubbery material.

In one aspect, multiple anchors can extend downwards from the upstanding walls for mounting the apparatus on the ground. In one exemplary embodiment, the anchors can be interchanged depending upon the site of installation. For example, for mounting the apparatus in soil, anchor stakes can be fastened to the walls, wherein the stakes can be pushed into the soil. For mounting the apparatus in the concrete base, suitable brackets or angles can be used. For the wooden base, brackets having screw holes can be used.

In one aspect, the "E"-shape frame of the apparatus can be made from tubular members, such as pipes or poles, and panels can be mounted in the tubular frame to form the left wall, the right wall, the rear wall, and the dividing wall. Similarly, the floor panels can also be mounted to the tubular frame. The anchors can extend downward from the vertical members of the tubular frame. For example, the tubular frame can have six vertical members at six vertices of the "E" shaped tubular frame and six anchors can be mounted to the lower ends of the six vertical members.

In one aspect, the rear wall can be divided at the dividing wall into two parts wherein the left wall, the first part of the rear wall, and the dividing wall form the left enclosure. Similarly, the right wall, the second part of the rear wall, and the dividing wall form the right enclosure. Two panels can be mounted to the rear wall. Each the left enclosure and the right enclosure can further have a floor panel or ramp.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
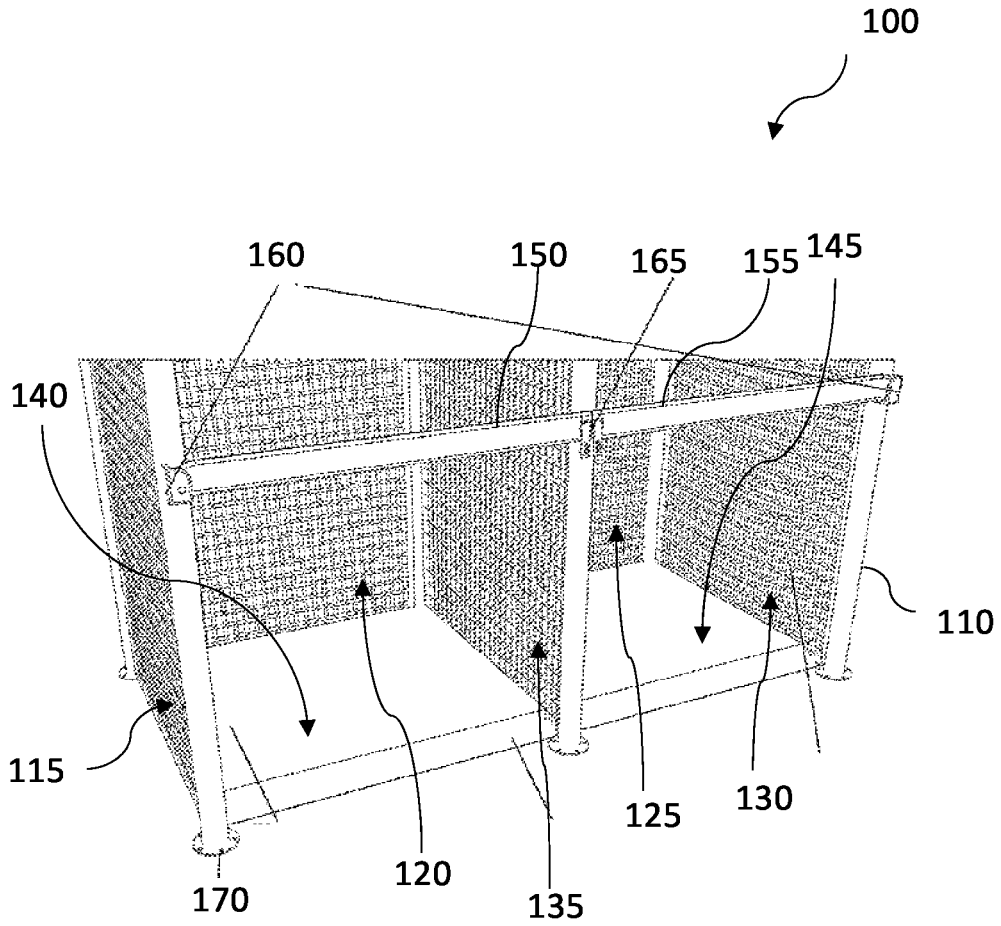
FIG. 1 is a perspective view of the apparatus showing the rectangular "E" shape frame with mounted panels and a floor ramp at the bottom forming two enclosures, two bars extend horizontally in front of the two enclosures, the bars mounted at one end through a pivot joint and a latch provided at the free end of the bar, according to an exemplary embodiment of the present invention.
Figure 2:
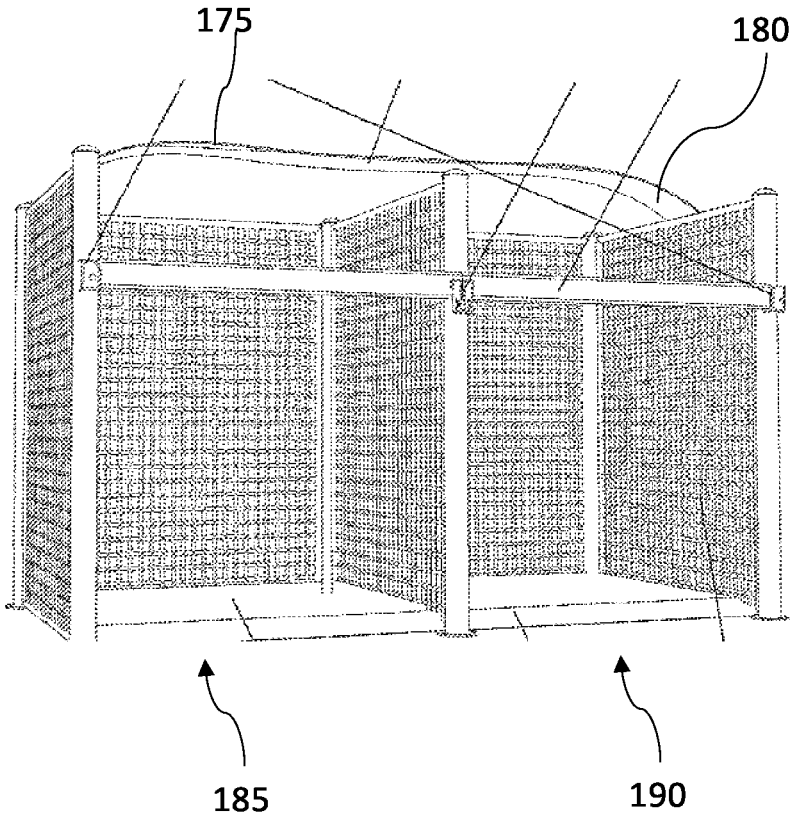
FIG. 2 is another perspective view of the apparatus, according to an exemplary embodiment of the present invention.
Figure 3:
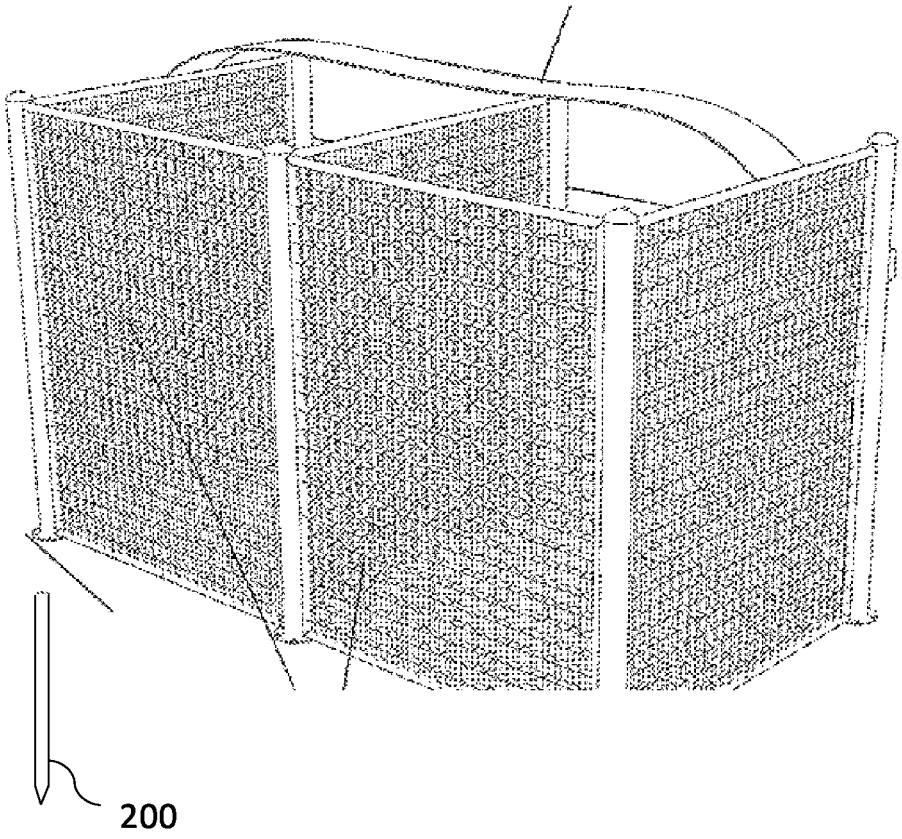
FIG. 3 is another perspective view of the apparatus also showing an anchor that can be mounted to lower ends of the frame, according to an exemplary embodiment of the present invention.
Figure 4:
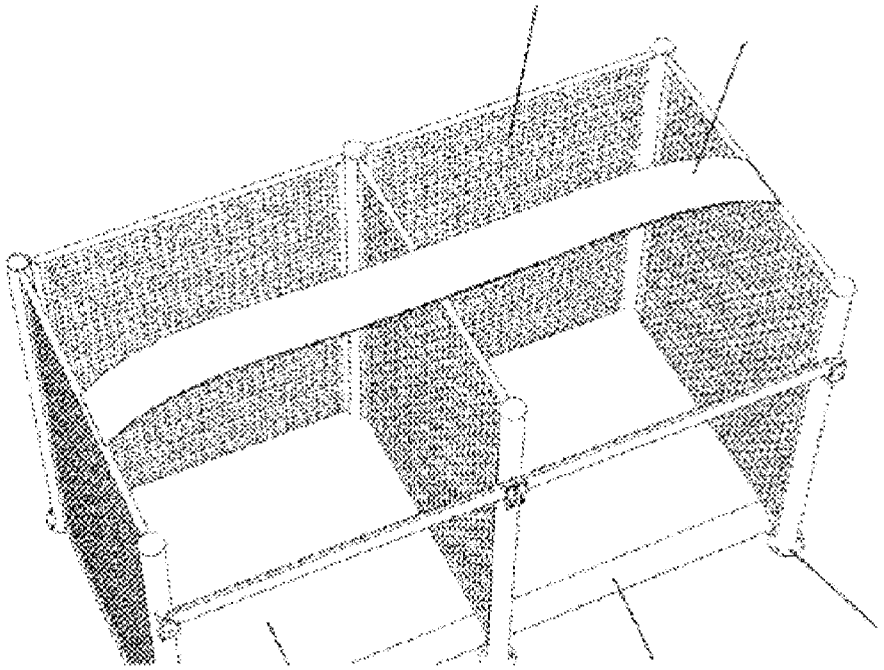
FIG. 4 is another perspective view of the apparatus, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is an apparatus for confining trash cans to prevent tipping or blowing away by winds. The disclosed apparatus can secure the trash cans as well as the lid of the trash cans overcoming the problems with the trash cans currently faced by people. The trash cans can be safely kept in alleys, front of houses, or street sides without the risk of the garbage littering from the trash cans or the smell of the food in garbage leaking out from the trash cans. People do not have to move the trash can in and out from the house and take a long walk for the garbage to be picked by the trashman. The disclosed apparatus also discourages the animals from coming around and rummaging through the garbage. The disclosed apparatus can be manufactured in a range of colors and designs, thus adding a visual appeal to the apparatus. The disclosed apparatus can be installed in alleys and roadside and have a tidy appearance. Moreover, advertisements can be applied to the apparatus.

Referring to FIGS. 1-4, showing different perspective views of the apparatus 100 showing a frame 110 of a substantially "E" shape. Frame 110 can include a left wall 115, a rear wall, a right wall 130, and a dividing wall 135. The rear wall can be seen divided at the dividing wall 135 between a first part of the rear wall 120 and a second part 125 of the rear wall. The left wall 115, the first part of the rear wall 120, and the dividing wall 135 form a left enclosure 185. The dividing wall 135, the second part of the rear wall 125, and the right wall 130 form a right enclosure 190. The left enclosure and the right enclosure both can accommodate a trash can. A bottom panel or ramp can also be provided upon which the trash cans can be placed. FIG. 1 shows a first ramp 140 in the left enclosure 185 and a second ramp 145 in the right enclosure 190. The bottom panels can be made from a rubbery material or at least a top layer of rubbery material can be implemented on the bottom panels. The bottom panels extend between the sidewalls and the dividing wall. It can be seen in drawings that the left wall 115, the right wall 130, and the dividing wall 135 are parallel to each other and perpendicular to the rear wall. However, it is understood that the side walls can be angled outwards or inwards at an acute or obtuse angle without departing from the scope of the present invention.

Each the left enclosure and the right enclosure can be covered at four sides, i.e., the left, right, rear, and bottom, while the front and the top can be open. Trash cans can be placed in each enclosure from the open front. It is understood that the apparatus can be expanded by increasing the length of the rear wall and using an additional dividing wall for additional enclosures. The rubber bottom panel can provide a grip to the trash cans against slippage.

The open front of the enclosure can be restricted by a barrier. FIG. 1 shows a first bar 150 horizontally extended between the left wall 115 and the dividing wall 135 of the left enclosure 185. A second bar 155 can also be seen that extends from the dividing wall 135 to the right wall 130 of the right enclosure 190. Both the bars can be mounted through hinge joints 160, such as the bar can be pivoted between an open position and the close position. The bar can be pivoted upwards to gain access for removing and putting the trash can in the enclosure. The pivoting of the bar can be secured by implementing a latch 165 at the free end of the bar. The latch can be switched between the open state and the close state for pivoting the bar.

The apparatus can be mounted to a flat surface such as the ground. Suitable anchors can be interchangeably implemented that allow the apparatus to be mounted to a different surface such as soil and concrete. A round flange 170 can be seen at bottom of the six vertical members of the frame. The anchors can be fastened to the six vertical members at the round flange 170 using fasteners. The anchors can also be permanently welded to the frame without departing from the scope of the present invention. In case of mounting on the ground, sharp-ended stakes made of metal can be implemented that can be hammered into the ground. In the case of a concrete base, suitable brackets or angles can be embedded in the concrete base. The disclosed apparatus can also be mounted to a wooden base wherein suitable fasteners, such as screws or nails can be used to fasten the round flange 170 to the wooden base.

In one exemplary embodiment, the frame 110 can be tubular made from poles, pipes, or similar members. The tubular frame can have six vertical members at six vertices of the "E" shape. The tubular members can be made from a durable material, such as metal. Two horizontal members can extend between the ends of two vertical members. FIG. 1 shows ten such horizontal members that extend between the six vertical members to form the substantially "E" shaped tubular frame. Panels can be mounted to the upstanding tubular frame forming a left wall, a right wall, and two parts of the rear wall. Two panels can be seen mounted on the rear wall dividing the rear wall into the first part and the second part. Two ramps can also be mounted at bottom of the tubular frame.

What is claimed is:

1. An apparatus for confining one or more trash cans, the apparatus comprising:

a left wall, a right wall, a rear wall, and a dividing wall forming a substantially E shape upstanding frame, wherein the left wall and the right wall extend from a left side and a right side of the rear wall, the dividing wall separates the rear wall into a first part and a second part, wherein the left wall, the first part of the rear wall, and the dividing wall define a left enclosure, wherein the dividing wall, the second part of the rear wall, and the right wall define a right enclosure, both the left enclosure and the right enclosure has an open front and an open-top;

a first barrier coupled to the left wall and the dividing wall for restricting access into the left enclosure from the open front of the left enclosure; and a second barrier coupled to the dividing wall and the right wall for restricting an access into the right enclosure from the open front of the right enclosure, wherein the apparatus further comprises a first strap and a second strap, the first strap extends from the left wall to the dividing wall, wherein the second strap extends from the dividing wall to the right wall, wherein each of the first strap and the second strap configured to secure a lid of a trash can in a close state.

2. The apparatus according to claim 1, wherein the first barrier is a horizontal first bar coupled at one end through a first hinge joint, wherein the first barrier can pivot between an open state and a close state, a first latch mechanism coupled to the left enclosure for securing the first barrier in the close state, and wherein the second barrier is a horizontal second bar coupled at one end through a second hinge joint, wherein the second barrier can pivot between an open state and a close state, a second latch mechanism coupled to the right enclosure for securing the second barrier in the close state.

3. The apparatus according to claim 2, wherein the apparatus further comprises a first fastening mechanism coupled to the first strap and configured to tighten or loosen the first strap.

4. The apparatus according to claim 3, wherein the apparatus further comprises a second fastening mechanism coupled to the second strap and configured to tighten or loosen the second strap.

5. The apparatus according to claim 4, wherein the apparatus further comprises a first ramp that extends between lower ends of the left wall and the dividing wall, the apparatus further comprises a second ramp that extends between lower ends of the dividing wall and the right wall.

6. The apparatus according to claim 5, wherein the first ramp and the second ramp have a top layer of rubbery material.

7. The apparatus according to claim 6, wherein the apparatus further comprises a plurality of anchors configured to mount the apparatus to a surface.

8. The apparatus according to claim 7, wherein the plurality of anchors is anchor stakes that extend downwards from the upstanding frame.

9. The apparatus according to claim 7, wherein the plurality of anchors is interchangeably mounted to the upstanding frame.

10. The apparatus according to claim 9, wherein the plurality of anchors are brackets configured to be embedded within a concrete base.

11. The apparatus according to claim 1, wherein the upstanding frame comprises a tubular frame and panels, wherein the panels are mounted to the tubular frame.

12. The apparatus according to claim 11, wherein the tubular frame comprises six vertical members and ten horizontal members, wherein two horizontal members of the ten horizontal members extend between ends of two vertical members of the six vertical members.

13. The apparatus according to claim 12, wherein a lower end of each vertical member of the six vertical members has a round flange, the round flange has spaced-apart holes for fasteners.

14. The apparatus according to claim 13, wherein six stakes extend downwards from the lower end of the six vertical members.

15. A method for confining one or more trash cans, the method comprising the steps of:

providing an apparatus comprising:

a left wall, a right wall, a rear wall, and a dividing wall forming a substantially E shape upstanding frame, wherein the left wall and the right wall extend from a left side and a right side of the rear wall, the dividing wall separates the rear wall into a first part and a second part, wherein the left wall, the first part of the rear wall, and the dividing wall define a left enclosure, wherein the dividing wall, the second part of the rear wall, and the right wall defines a right enclosure, both the left enclosure and the right enclosure has an open front and an open-top, a first barrier coupled to the left wall and the dividing wall for restricting access into the left enclosure from the open front of the left enclosure, and a second barrier coupled to the dividing wall and the right wall for restricting an access into the right enclosure from the open front of the right enclosure, the first barrier is a horizontal bar coupled at one end through a hinge joint, wherein the first barrier can pivot between an open state and a close state, a latch mechanism coupled to the left enclosure for securing the first barrier in the close state, the second barrier is a horizontal bar coupled at one end through a second hinge joint, wherein the second barrier can pivot between an open state and a close state, a second latch mechanism coupled to the right enclosure for securing the second barrier in the close state, and a first strap and a second strap, the first strap extends from the left wall to the dividing wall, wherein the second strap extends from the dividing wall to the right wall, wherein each of the first strap and the second strap configured to secure a lid of a trash can in a closed state;

placing a first trash can in the left enclosure;

tightening the first strap against a lid of the first trash can; and pivoting the first barrier to the close state by latching the first barrier.

16. The method according to claim 15, wherein the method further comprises the steps of:

placing a second trash can in the right enclosure;

tightening the second strap against a lid of the second trash can; and pivoting the second barrier from the open state to the close state by latching the second barrier.

* * * * *